US011158442B2

(12) United States Patent
Varkey et al.

(10) Patent No.: US 11,158,442 B2
(45) **Date of Patent: *Oct. 26, 2021**

(54) MANUFACTURING TECHNIQUES FOR A JACKETED METAL LINE

(71) Applicant: Schlumberger Technology Corporation, Sugar Land, TX (US)

(72) Inventors: Joseph Varkey, Sugar Land, TX (US); Burcu Unal Altintas, Richmond, TX (US); Jushik Yun, Sugar Land, TX (US); Dong Yang, Sugar Land, TX (US); Sheng Chang, Sugar Land, TX (US); Ramnik Singh, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/034,639

(22) Filed: Jul. 13, 2018

(65) Prior Publication Data

US 2018/0330851 A1 Nov. 15, 2018

Related U.S. Application Data

(63) Continuation of application No. 14/678,270, filed on Apr. 3, 2015, now Pat. No. 10,037,836.

(51) Int. Cl.
*E21B 23/14* (2006.01)
*B05D 1/00* (2006.01)
(Continued)

(52) U.S. Cl.
CPC ..... *H01B 13/24* (2013.01); *B05D 1/007* (2013.01); *C23C 4/06* (2013.01); *C23C 4/131* (2016.01);
(Continued)

(58) Field of Classification Search
CPC ..... E21B 23/14; H01B 13/24; B05D 1/007; C23C 4/06; C23C 4/131; C23C 4/16; C23C 4/18
See application file for complete search history.

(56) References Cited

U.S. PATENT DOCUMENTS 1,867,289 A 7/1932 Ercole et al.
2,481,637 A 9/1949 Yancey et al.
(Continued)

FOREIGN PATENT DOCUMENTS

CN 105269047 A 1/2016
EP 2960428 A2 12/2015
(Continued)

OTHER PUBLICATIONS

International Search Report and Written Opinion issued in PCT Application PCT/US2019/039682, dated Oct. 24, 2019 (14 pages).
(Continued)

*Primary Examiner* — Matthew R Buck
(74) *Attorney, Agent, or Firm* — Ashley E. Brown

(57) ABSTRACT

A method of manufacturing a jacketed metal line is detailed herein. The method of manufacturing a jacketed metal line can include roughening an outer surface of a metal core of the line. An insulating polymer layer can be applied to the metal core, and the insulating polymer layer can include a reinforcing additive comprising: graphite, carbon, glass, aramid, short-fiber filled PolyEtherEtherKetone, mircron-sized polytetrafluoroethylene, or combinations thereof. The roughened metal core can then be exposed a heat source for at least partially melting the polymer layer; and the partially melted polymer layer and insulated roughened metal core can be ran through a set of shaping rollers.

16 Claims, 6 Drawing Sheets

(51) Int. Cl.

| | |
|---|---|
| ***C23C 4/06*** | (2016.01) |
| ***C23C 4/131*** | (2016.01) |
| ***C23C 4/16*** | (2016.01) |
| ***C23C 4/18*** | (2006.01) |
| ***H01B 13/24*** | (2006.01) |
| *B05D 3/12* | (2006.01) |
| *B05D 3/14* | (2006.01) |
| *B05D 7/00* | (2006.01) |

(52) U.S. Cl.
CPC ..... *C23C 4/16* (2013.01); *C23C 4/18* (2013.01); *B05D 3/12* (2013.01); *B05D 3/14* (2013.01); *B05D 7/52* (2013.01); *B05D 2202/00* (2013.01); *B05D 2256/00* (2013.01); *B05D 2401/00* (2013.01)

(56) References Cited

U.S. PATENT DOCUMENTS 2,735,485 A 2/1956 Metcalf, Jr.
2,899,000 A 8/1959 Medders et al.
3,248,253 A * 4/1966 Barford ..... B05B 5/14 427/459
3,802,974 A * 4/1974 Emmel ..... H01B 7/0838 156/55
4,565,252 A 1/1986 Campbell et al.
4,889,197 A 12/1989 Boe
4,957,612 A * 9/1990 Stewart ..... C23F 13/02 204/196.38
5,035,293 A 7/1991 Rives
5,036,921 A 8/1991 Pittard et al.
5,060,738 A 10/1991 Pittard et al.
5,074,355 A 12/1991 Lennon
5,210,377 A * 5/1993 Kennedy ..... H01B 11/1839 174/107
5,392,858 A 2/1995 Peters et al.
5,447,207 A 9/1995 Jones
5,582,260 A 12/1996 Murer et al.
5,899,268 A 5/1999 Lynde et al.
6,009,961 A 1/2000 Pietrobelli et al.
6,125,929 A 10/2000 Davis et al.
6,202,752 B1 3/2001 Kuck et al.
6,357,528 B1 3/2002 Davis et al.
6,401,821 B1 6/2002 Kennedy et al.
6,679,328 B2 1/2004 Davis et al.
6,920,923 B1 7/2005 Pietrobelli et al.
7,143,848 B2 12/2006 Armell
7,314,099 B2 1/2008 Dewey et al.
7,326,854 B2 * 2/2008 Varkey ..... H01B 7/046 174/102 R
7,462,781 B2 * 12/2008 Varkey ..... H01B 7/046 174/102 R
7,540,327 B2 6/2009 Billingham
7,793,409 B2 * 9/2010 Varkey ..... H01B 13/24 174/102 R
7,909,100 B2 3/2011 Bryant, Jr. et al.
7,934,311 B2 * 5/2011 Varkey ..... H01B 13/016 174/102 R
8,082,988 B2 12/2011 Redlinger et al.
8,210,251 B2 7/2012 Lynde et al.
8,413,723 B2 * 4/2013 Varkey ..... E21B 17/206 166/339
8,540,035 B2 9/2013 Xu et al.
8,955,597 B2 2/2015 Connell et al.
9,097,073 B2 8/2015 Schmidt et al.
9,187,971 B2 11/2015 Hutchinson
9,353,589 B2 5/2016 Hekelaar
9,359,853 B2 6/2016 Nas et al.
9,366,101 B2 6/2016 Colbert et al.
9,556,696 B2 1/2017 Donovan et al.
9,617,815 B2 4/2017 Schwartze et al.
9,644,472 B2 5/2017 Fuhst et al.
9,725,977 B2 8/2017 Laird et al.
2002/0144815 A1 10/2002 Van Drentham-Susman et al.
2004/0045659 A1 * 3/2004 Kobayashi ..... B05B 5/12 156/230
2004/0245020 A1 12/2004 Giroux et al.
2005/0039905 A1 2/2005 Hart et al.
2007/0251687 A1 11/2007 Martinez et al.
2008/0115972 A1 5/2008 Lynde et al.
2009/0266544 A1 10/2009 Redlinger et al.
2010/0006290 A1 1/2010 Saylor et al.
2010/0065264 A1 3/2010 Nackerud
2011/0278064 A1 11/2011 Rasheed
2012/0152543 A1 6/2012 Davis
2012/0305249 A1 12/2012 Connell et al.
2012/0325480 A1 12/2012 Schmidt et al.
2013/0227837 A1 * 9/2013 Varkey ..... G02B 6/4488 29/825
2013/0233587 A1 * 9/2013 Varkey ..... D07B 1/0693 174/110 SR
2014/0096947 A1 4/2014 Colbert et al.
2015/0034311 A1 2/2015 Tunget
2015/0129195 A1 5/2015 Laird et al.
2015/0239795 A1 * 8/2015 Doud ..... C06B 45/18 428/649
2015/0267493 A1 9/2015 Schwartze et al.
2016/0245032 A1 8/2016 Hekelaar et al.
2016/0293298 A1 10/2016 Varkey et al.
2016/0348453 A1 12/2016 Robertson et al.
2018/0128071 A1 5/2018 Clem et al.

FOREIGN PATENT DOCUMENTS

WO WO2014137315 A1 9/2014
WO WO2014150524 A1 9/2014
WO WO2015054227 A2 4/2015
WO WO2015191572 A1 12/2015
WO WO2016011085 A1 1/2016
WO WO2016148682 A1 9/2016
WO WO2016191720 A1 12/2016
WO WO2017039983 A1 3/2017
WO 2020006333 A1 1/2020

OTHER PUBLICATIONS

International Preliminary Report on Patentability issued in PCT Application PCT/US2019/039682, dated Jan. 7, 2021 (10 pages).

* cited by examiner

MANUFACTURING TECHNIQUES FOR A JACKETED METAL LINE

CROSS-REFERENCE TO RELATED APPLICATIONS

This Application is a continuation application of U.S. patent application Ser. No. 14/678,270, entitled: "SLICK-LINE MANUFACTURING TECHNIQUES", filed on Apr. 3, 2015, the entirety of which is incorporated herein by reference.

BACKGROUND

Exploring, drilling and completing hydrocarbon and other wells are generally complicated, time consuming, and ultimately very expensive endeavors. In recognition of these expenses, added emphasis has been placed on efficiencies associated with well completions and maintenance over the life of the well. So, for example, enhancing efficiencies in terms of logging, perforating or any number of interventional applications may be of significant benefit, particularly as well depth and complexity continues to increase.

One manner of conveying downhole tools into the well for sake of logging, perforating, or a variety of other interventional applications is to utilize slickline. A slickline is a low profile line or cable of generally limited functionality that is primarily utilized to securely drop the tool or toolstring vertically into the well. However, with an increased focus on efficiency, a slickline may be provided with a measure of power delivering or telemetric capacity. This way, a degree of real-time intelligence and power may be available for running an efficient and effective application. That is, instead of relying on a downhole battery of limited power, a manner of controllably providing power to the tool from oilfield surface equipment is available as is real-time communications between the tool and the surface equipment.

As with a less sophisticated slickline lacking power and communications, a metal wire may be utilized in a slickline equipped with power and communications. However, in the latter case, the metal wire may be configured to relay charge. Thus, in order to ensure functionality and effectiveness of the wire it may be jacketed with a polymer to insulate and prevent exposure of the wire to the environment of the well.

Of course, in order to remain effective, a jacket material may be utilized that is configured to withstand the rigors of a downhole well environment. Along these lines, a jacket material is also utilized that is intended to bond well with the underlying slickline wire. Unfortunately, however, inherent challenges exist in adhering a polymer jacket material onto a metal wire. As a result, a loose point, crack or other defect at the interface of the jacket and wire may propagate as the slickline is put to use. For example, an unbonded area at the jacket and wire interface may spread as the slickline is randomly spooled from or onto a drum at the oilfield surface. If not detected ahead of time by the operator, this may lead to a failure in the jacket during use in a downhole application. Depending on the application at hand, this may translate into several hours of lost time and expense followed by a repeated attempt at performing the application.

Efforts have been undertaken to improve the bonding between the polymer jacket and underlying wire. For example, the wire may be heated by several hundred degrees ° F. before compression extruding the polymer onto the wire. In theory, a tight molded delivery of the polymer to the wire may be achieved in this way with improved bonding between the wire and the polymer.

Unfortunately, this type of heated compression extruding presents numerous drawbacks. For example, the bonding between the wire and the polymer jacket material may not always be improved. In fact, due to the different rates of cooling, with the jacket material cooling more slowly than the metal wire, the wire may shrink away from the jacket material and allow air pockets to develop at the interface between the wire and forming jacket. This not only results in a failure of adherence at the location of the air pocket but this is a defect which may propagate and/or become more prone to damage during use of the slickline. Once more, heating the wire in this manner may also reduce its strength and render it less capable in terms of physically delivering itself and heavy tools to significant well depths for a downhole application.

On a related note, extruding of the polymer jacket material as noted above is achieved by tightly and compressibly delivering the material onto the wire. That is, a markedly tight stress is imparted on the wire as the material is delivered. Again, in theory this may promote adherence between the polymer and the underlying wire. Unfortunately, while this may initially be true, compression extruding in this manner may smooth the surface of the wire as the polymer material is delivered. Thus, a long term grip on the wire by the material may be adversely affected due to the increased underlying smoothness of the wire.

Ultimately, to a large degree, efforts which have been undertaken to enhance the bond between the polymer jacket and the underlying wire have been counterproductive. Thus, challenges remain in terms of reliably utilizing a slickline with power and telemetric capacity built thereinto.

SUMMARY

A method of manufacturing a jacketed metal line is detailed herein. An example of a disclosed method of manufacturing a jacketed metal line can include roughening an outer surface of a metal core of the line. An insulating polymer layer can be applied to the metal core, and the insulating polymer layer can include a reinforcing additive comprising: graphite, carbon, glass, aramid, short-fiber filled PolyEtherEtherKetone, mircron-sized polytetrafluoroethylene, or combinations thereof. The roughened metal core can then be exposed a heat source for at least partially melting the polymer layer; and the partially melted polymer layer and insulated roughened metal core can be ran through a set of shaping rollers.

Another example of a method of manufacturing a jacketed metal line can include charging a metal core of the line, and powder coating the charged line with an oppositely charged insulating polymer. The insulated metal core can be exposed to a heat source for at least partially melting the polymer; and the insulated metal core with the partially melted polymer layer can be ran through a set of shaping rollers.

Another example of the method of manufacturing a polymer jacketed metal line can include placing a short-fiber filled PolyEtherEtherKetone layer about a roughened metal core, and placing a polymer alloy layer about the short-fiber filled PolyEtherEtherKetone layer, wherein the polymer alloy layer comprises fluoropolymer particles in a matrix of PEEK.

DETAILED DESCRIPTION

Embodiments are described with reference to certain manufacturing techniques that are applicable to polymer jacketed metal lines. The disclosed embodiments herein focus on polymer jacketed slickline. However, such techniques may also be utilized in the manufacture of jacketed metallic tubes, cladded lines, wire rope, armored cable, coiled tubing, casing, monitoring cables and a variety of other metal line types to be jacketed. As used herein, the term "slickline" is meant to refer to an application that is run over a conveyance line that is substantially below 0.25-0.5 inches in overall outer diameter. However, as indicated, other, potentially larger lines may benefit from the techniques detailed herein. Additionally, the embodiments detailed herein are described with reference to downhole applications, such as logging applications, run over slickline. However, other types of downhole applications and line types may take advantage of jacketed lines manufactured according to techniques detailed herein such as, but not limited to downhole applications such as sampling, fishing, clean-out, setting, stimulation, logging, perforating, mechanical services and a variety of other downhole applications. So long as a non-compression technique such as tubing extrusion is utilized to deliver a polymer to a roughened metal core followed by heating and rolling, appreciable benefit may be realized in the reliability and durability of the line for downhole applications.

Figure 1:
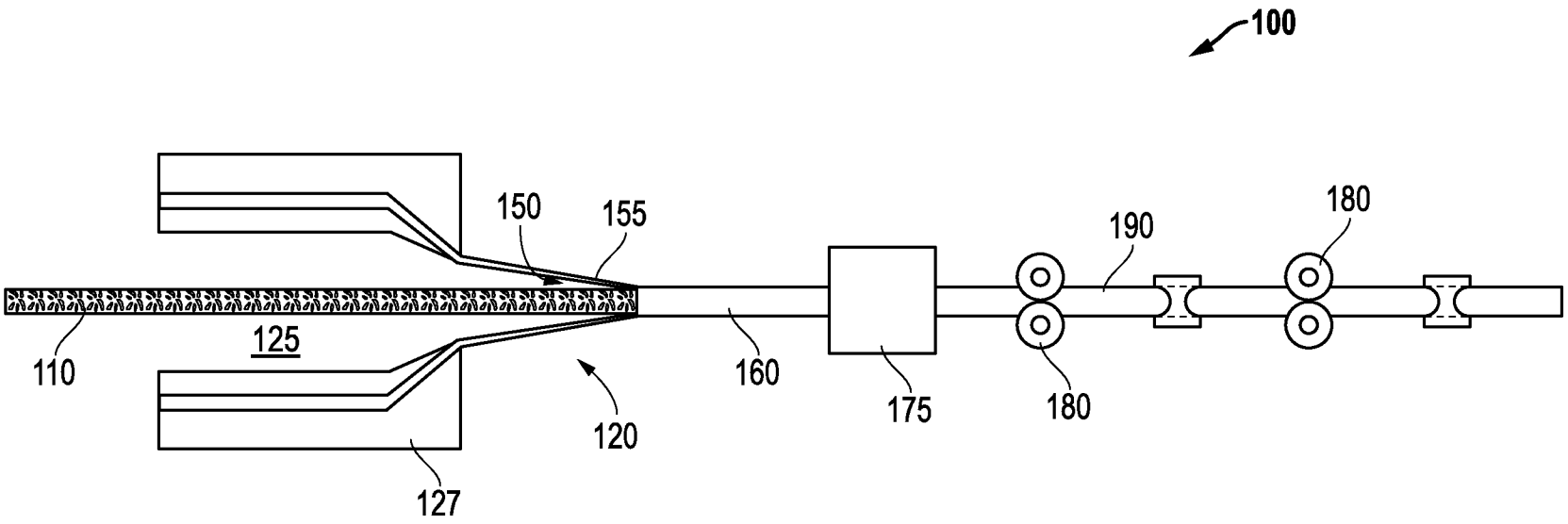
FIG. 1 is a side schematic representation of an embodiment of a slickline manufacturing technique.

Referring specifically now to FIG. 1, a side schematic representation of an embodiment of a slickline manufacturing technique 100 is shown. As alluded to above, the depicted layout and technique may be utilized for the manufacture of any number of different polymer jacketed metal lines. As used herein, the term "metal line" is meant to refer to a type of line or conveyance that includes a core with an outermost layer that is of a metal based material in advance of the polymer jacketing. For example, the depicted slickline 190 of FIG. 1 includes a roughened metal core 110 that is ultimately jacketed by a polymer 155. In the embodiment shown, this metal core 110 may be a monolithic wire for sake of supporting power or telemetry through the slickline 190. For example, an austenitic stainless steel alloy may be utilized. Of course, in other embodiments, the core 110 may still have an outer metal surface but be more complex with other underlying layers of differing materials for sake of telemetry, support or other forms of power transmission.

Regardless of the particular configuration, as shown in FIG. 1, the metal core 110 is advanced through a tubing extrusion process, indicated generally at 120. The metal core 110 may be heated by a heat source, such as the heat source 275 in FIGS. 2*a*-2*c* discussed in more detail hereinbelow, prior to advancing into the tubing extrusion process 120. As indicated, the core 110 includes a roughened outer surface formed through one of a variety of techniques such as arc spraying, sandblasting, or electrolytic plasma coating (see FIGS. 2A-2C). In one embodiment, a layer of powder coating may even be provided to the bare core 110. Regardless, once roughening is achieved, the core 110 is advanced through a non-compression technique such as, but not limited to, tubing extrusion for receiving a thin polymer layer thereabout, perhaps between about 0.001 and about 0.010 inches in thickness. Specifically, as noted above, in the embodiment of FIG. 1, a tubing extrusion process 120 is utilized to deliver a polymer 155. Tubing extrusion may include passing the core 110 through a chamber 127 with a vacuum 125 and then exposing the core 110 to the polymer 155 to be jacketed thereabout. The vacuum 125 may be utilized to draw the polymer 155 onto the core 110 as opposed to utilizing more forcible measures.

Unlike compression extrusion, the tubing extrusion process 120 allows for more of a loose transition or tapered interfacing 150 as the polymer 155 is brought about the core 110. Thus, in contrast to compression extruding, this would appear to provide less of a grip by the polymer onto the surface of the core 110. That is, a forcible mode of direct compression is not immediately imparted as the polymer 155 is placed about the core 110. However, this also means that as the polymer 155 is added to the core 110, the polymer 155 is added without measurably affecting the roughened surface of the core 110.

With the roughened surface of the core 110 preserved and a thin layer of polymer 155 thereover, the grip between the core 110 and this initial polymer layer 155 may subsequently be enhanced. Specifically, as shown in FIG. 1, the jacketed core 160 is exposed to a heat source 175 and later shaping rollers 180 to create a uniform substantially circular profile. The shaping rollers 180 may also remove air trapped between the polymer layer 155 and the core 110 and improve the adhesion of the polymer layer 155 to the surface of the core 110. In this manner, the newly placed polymer layer 155 may be melted by exposure to a heat source 175 such as an infrared source and then compressibly shaped relative to the underlying roughened surface of the core 110. Thus ultimately, even though the compressible forces are intentionally displaced until a later time, as compared to compression extrusion, the grip is enhanced at a time and in a manner that avoids unnecessary damage to the bonding components. That is, the core 110 and polymer 155 are spared unnecessary processing related damage as they are brought together. Instead, subsequent heating and compressible shaping take place to achieve a better grip than might otherwise be possible through an initial compression extrusion that might smooth the core 110 during addition of the polymer 155. In a non-limiting embodiment, the extrusion process 120 may be accomplished in separate steps at differing times, for example, by first providing the core 110 and placing the polymer layer 155 on the core to form the jacketed core 160, and subsequently heating the jacketed core 160 with the heating source 175 and rolling with the shaping rollers 180, as shown in FIG. 1.

The particular polymer utilized may be determined based on the particular use for the jacketed line. For example, in the embodiment of FIG. 1 (or FIG. 3 or 4) where the processed line is to be utilized in downhole applications as slickline 190, 390, downhole conditions, depths and applications may play a role in the type of polymer 155 selected.

For example, where higher strength and temperature resistance is sought, the polymer 155 may be a polyetheretherketone (PEEK) (which may comprise one or more members of the polyetheretherketone family) or similarly pure or amended polymer. These may include a carbon fiber reinforced PEEK short-fiberfilled PolyEtherEtherKetone (SFF-PEEK), polyether ketone, and polyketone, polyaryletherketone. Where resistance to chemical degradation or decomposition (such as a reaction between the polymer 155 and a wellbore fluid) is of most primary concern, the polymer 155 may be a fluoropolymer. Suitable fluoropolymers may include ethylene tetrafluoroethylene, ethylene-fluorinated ethylene propylene and perfluoroalkoxy polymer or any member of the fluoropolymer family. Where a less engineered and more cost-effective material choice is viable, the polymer 155 may be a polyolefin such as high density polyethylene, low density polyethylene, ethylene tetrafluoroethylene or a copolymer thereof or any member of the polyolefin family. Such PEEK, fluoropolymer and polyolefin materials may be available with or without a reinforcing additive such as graphite, carbon, glass, aramid or micron-sized polytetrafluoroethylene.

Of course, a variety of different bonding facilitating polymer additives may be incorporated into the polymer 155 as well. These may include modified polyolefins, modified TPX (a 4-methylpentene-1 based, crystalline polyolefin) or modified fluoropolymers with adhesion promoters incorporated thereinto. These promoters may include unsaturated anhydrides, carboxylic acid, acrylic acid and/or silanes. In the case of modified fluoropolymers in particular, adhesion promoters may also include perfluoropolymer, perfluoroalkoxy polymer, fluoroinated ethylene propylene, ethylene tetrafluoroethylene, and ethylene-fluorinated ethylene propylene. In an embodiment, the bonding facilitating polymer additives noted above may comprise a separate layer, or tie layer, extruded or otherwise placed over the polymer 155. The tie layer may comprise any material that enables and/or promotes bonding between the polymer, such as the polymer 155, and a metal substrate, such as the core 110, and/or enables and/or promotes bonding between layers of polymers.

As indicated above, the polymer 155 is provided to a metal core 110 with a roughened outer surface. Thus, referring now to FIGS. 2A-2C, techniques by which a smooth, non-roughened or untreated version of the metal core 200 may be roughened to form the core 110 referenced above are depicted. Specifically, FIG. 2A depicts an embodiment of arc spraying applied to the core 200, FIG. 2B depicts an embodiment of sandblasting the core 200 and FIG. 2C depicts an embodiment of electrolytic plasma coating applied to a charged version of the core 201 as detailed further below.

Figure 2A:
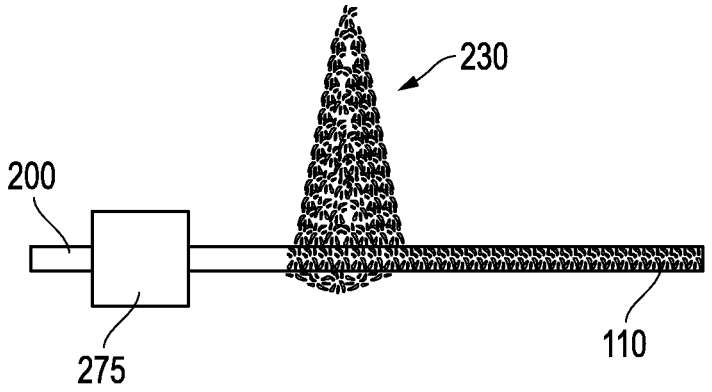
FIG. 2A is a side schematic view of an embodiment of preparing a metal core for the technique of FIG. 1.

With specific reference to FIG. 2A, arc spraying of the smooth core 200 involves the application of an arc spray 230. In an embodiment, the core 200 may be heated by exposure to an infrared or other suitable heat source 275 just prior to the application of the arc spray 230. In this way, bonding between material of the arc spray 230 and the smooth core 200 may be enhanced. The noted material of the arc spray 230 may be molten droplets of a metal based material that are formed by feeding different positively and negatively energized wires through a gun head. A resultant arc of these wires may provide the molten material which is then sprayed via dry compressed air as the arc spray 230 depicted in FIG. 2A in order to provide the roughened surface core 110.

Figure 2B:
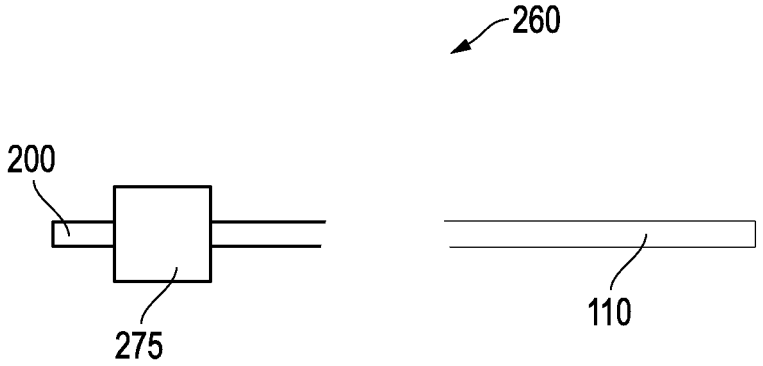
FIG. 2B is a side schematic view of another embodiment of preparing a metal core for the technique of FIG. 1.

With specific reference to FIG. 2B the sandblasting technique depicted may involve heating the core 200, in this case for surface receptiveness to the blasting. As depicted, an infrared or other suitable heat source 275 may be utilized. The heated core 200 is then sandblasted or otherwise "abrasive blasted" with a fine-grit medium to roughen the surface and provide the core 110 as detailed hereinabove.

Figure 2C:
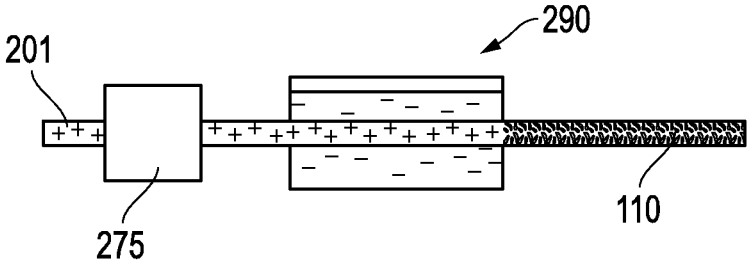
FIG. 2C is a side schematic view of yet another embodiment of preparing a metal core for the technique of FIG. 1.

With particular reference to FIG. 2C, an embodiment of electrolytic plasma coating of a smooth core 201 is shown. In this embodiment, a liquid bath 290 containing metals for bonding to the surface of the charged core 201 is provided. The metals of the bath 290 may be oppositely charged. For example, in the embodiment shown, these metals are negatively charged whereas the smooth core 201 is positively charged as it is drawn through the bath 290. The opposite charges in combination with the heated state of the core 201 may result in a roughened core 110 with metals adhered at its outer surface and receptive to jacketing as detailed above. In an embodiment, the core 201 may be initially charged and then heated, for example, by an infrared heat source 275 to enhance subsequent bonding.

In a similar embodiment, an initial jacketing with the polymer 155 as detailed above may take place in the form of a charged powder coating. That is, the core 201 is charged as depicted in FIG. 2C but then directly exposed to a powder coating of polymer that is oppositely charged. Thus, the initial polymer layer that is provided on the core 201 is enhanced in terms of bonding thereto. Therefore, a jacketed core 160 is provided as depicted in FIG. 1 that may be advanced to shaping rollers 180 and continued processing. Indeed, where the core 160 remains of an elevated temperature, re-heating for sake of running through the shaping rollers 180 may be avoided.

Figure 3:
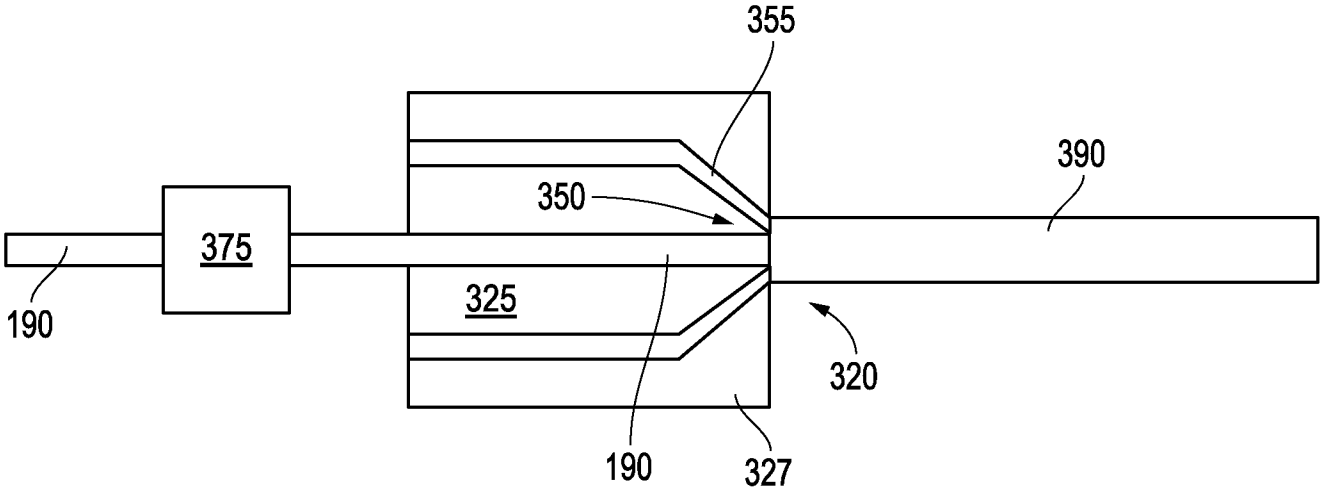
FIG. 3 is a side schematic view of an embodiment of introducing an outer jacket to the slickline of FIG. 1.

Referring now to FIG. 3 a side schematic view of an embodiment of introducing an outer jacket to the slickline 190 of FIG. 1 is shown. This is achieved by running the slickline 190 with initial polymer layer through another extrusion for application of the outer polymer 355. However, as shown, the extrusion may be achieved with a compression extrusion 320. That is, since the underlying roughened surface of the core 110 of FIG. 1 (and FIGS. 2A-2C), is now covered by an initial thin layer of polymer 155, compression extrusion may be utilized without undue concern over the process affecting the bonding between these components (110 and 155).

Specifically, as shown in FIG. 3, the polymer coated slickline 190 may be heated by exposure to a heat source 375 such as an infrared heater and then advanced into a compression extruder chamber 327. However, the transitioning interface 350 between this outer polymer 355 and the underlying slickline 190 is tight and abrupt. Thus, an immediate forcible delivery of the outer polymer 355 is provided in a manner that may enhance the bonding to the underlying slickline 190 and its initial polymer 155 (see FIG. 1). Thus, an outer jacketed slickline 390 may be provided. In one embodiment, this slickline may again be heated and/or run through another set of shaping rollers before completion. Regardless, a completed slickline 390 is achieved wherein an initial polymer 155 is provided through a non-compression technique and any subsequent outer jacketing is provided through compression extrusion. Thus, at no point is bonding between a polymer and a metal core adversely affected by premature compression extrusion. In an embodiment, a tie layer, comprising the bonding facilitating polymer additives noted above may be extruded or otherwise placed over the polymer 355 or between the polymers 155 and 355. The tie layer may comprise any material that enables and/or promotes bonding between the polymer, such as the polymer 155, and a metal substrate, such as the core 110, and/or enables and/or promotes bonding between layers of polymers, such as the polymers 155 and 355. For example, where higher strength and temperature resistance is sought, the polymer 155 and/or 355 may be a polyetheretherketone (PEEK) or similarly pure or amended polymer. These may include a carbon fiber reinforced PEEK, polyether ketone, and polyketone, polyaryletherketone. Where resistance to chemical degradation or decomposition (such as a reaction between the polymer 155 or 355 and a wellbore fluid) is of most primary concern, the polymer 155 and/or 355 may be a fluoropolymer. Suitable fluoropolymers may include ethylene tetrafluoroethylene, ethylene-fluorinated ethylene propylene and perfluoroalkoxy polymer. Where a less engineered and more cost-effective material choice is viable, the polymer 155 and/or 355 may be a polyolefin such as high density polyethylene, low density polyethylene, ethylene tetrafluoroethylene or a copolymer thereof. Such PEEK, fluoropolymer and polyolefin materials may be available with or without a reinforcing additive such as graphite, carbon, glass, aramid or micron-sized polytetrafluoroethylene.

In one or more embodiments, the slickline can be made by placing an initial polymer layer of SFF-PEEK about a metallic component, and placing a second layer of virgin PEEK about the SFF-PEEK. The SFF-PEEK may contain short fiber filler material. The short fiber material may comprise from 0.5% to 30% of the total volume of the SFF-PEEK. The fiber used may be Carbon, glass, an inorganic fiber or filler, or any other suitable material with a low coefficient of thermal expansion. For example, a single-strand wire that comprises the center of a conductor can have a layer of SFF-PEEK extruded thereabout. The SFF-PEEK can be heated and slightly melt the SFF-PEEK, and a virgin PEEK can be extruded about the SFF-PEEK.

In another embodiment, the slickline can be made by placing SFF-PEEK about a metallic component, and then placing a fluoropolymer/PEEK alloy (Doped PEEK) about the SFF-PEEK, forming a bonded fluoropolymer outer jacket. The Doped PEEK can contain fluoropolymer particles in a matrix of PEEK. The fluoropolymer particles can rise as the material cools to form a bonded fluoropolymer outer skin. For example, a single-strand wire that comprises the center of a conductor can have a layer of SFF-PEEK extruded thereabout. The SFF-PEEK can be heated and slightly melt the SFF-PEEK, and a layer of Doped PEEK can be extruded about the SFF-PEEK. As the Doped PEEK cools, fluoropolymer particles in the Doped PEEK can diffuse to the surface to form an impervious fluoropolymer layer.

In an embodiment, the slickline can be made by placing SFF-PEEK about a metallic component, then placing a fluoropolymer/PEEK alloy (Doped PEEK) about the SFF-PEEK, forming a bonded fluoropolymer outer jacket. An additional layer of pure fluoropolymer, forming a final bonded jacket of pure fluoropolymer. For example, a single-strand wire that comprises the center of a conductor can have a layer of SFF-PEEK extruded thereabout. The SFF-PEEK can be heated and slightly melt the SFF-PEEK, and a layer of Doped PEEK can be extruded about the SFF-PEEK. As the Doped PEEK cures, fluoropolymer particles in the Doped PEEK can diffuse to the surface to form an impervious fluoropolymer skin over the Doped PEEK. The fluoropolymer skin of the Doped PEEK layer can be heated to slightly soften the fluoropolymer skin, and a layer of Virgin Fluoropolymer can be extruded about the outer fluoropolymer skin.

Figure 4:
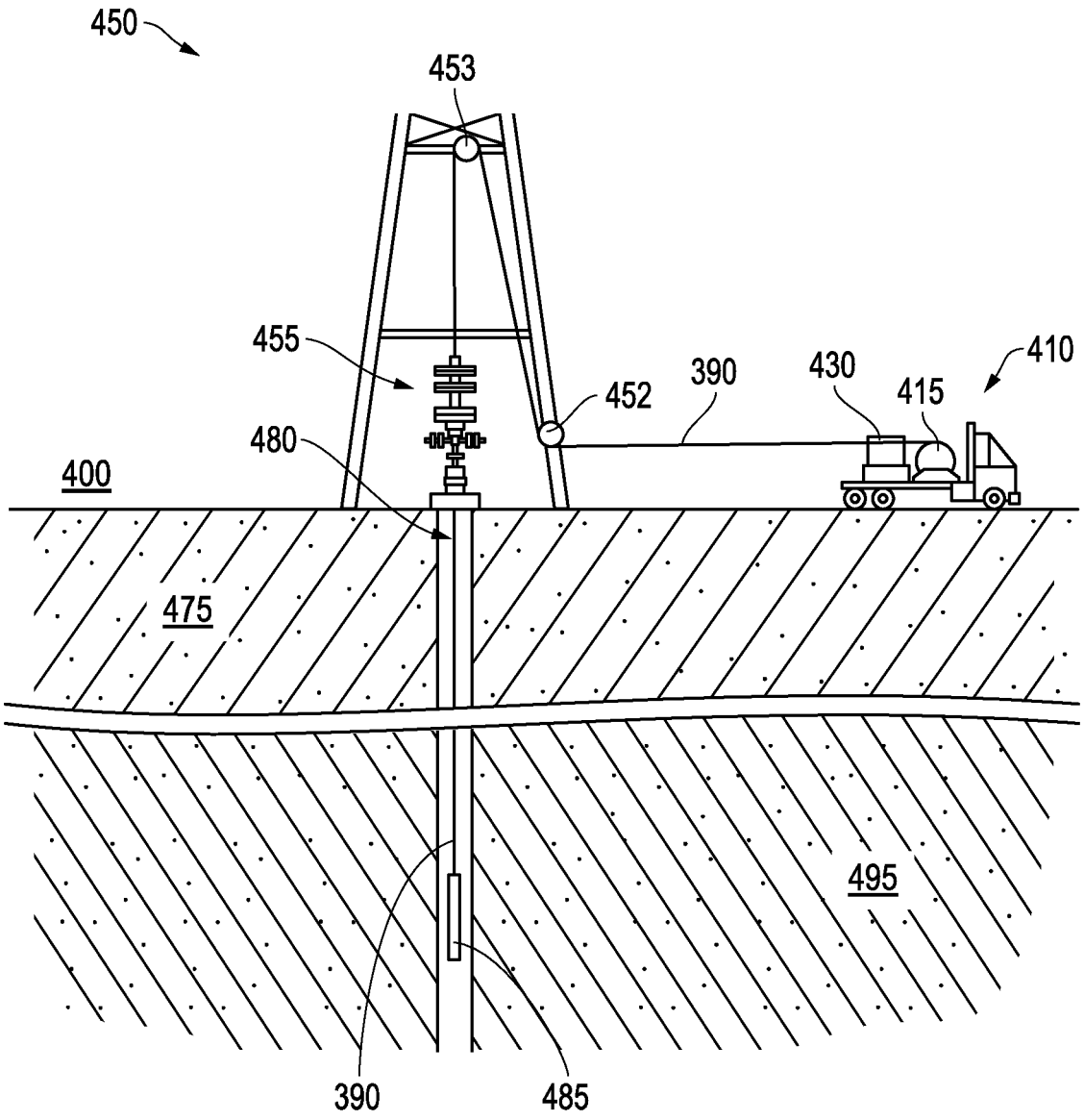
FIG. 4 is an overview of an oilfield with a well accommodating the slickline of FIG. 3 for an application run therein.

Referring now to FIG. 4, an overview of an oilfield 400 is shown with a well 480 that accommodates the completed slickline 390 of FIG. 3. The slickline 390 is used to deliver a logging tool 485 for sake of a logging application in which well characteristic information is acquired as the tool 485 traverses various formation layers 475, 495. Thus, the logging application and tool 485 may benefit from the capacity for telemetry and/or power transfer over the slickline 490. For example, as shown in FIG. 4, the oilfield is outfitted with a host of surface equipment 450 such as a truck 410 for sake of mobile slickline delivery from a drum 415. However, in the embodiment shown, the truck 410 also accommodates a control unit 430 which may house a processor and power means for interfacing with the downhole logging tool 485. Thus, rather than run a logging application with a tool limited to a downhole battery and recorder for later analysis, an application may be run in which the tool 485 is provided with sufficient power and data therefrom is acquired by the unit 430 in real-time.

In order to run such a real-time downhole application as described above, the slickline 390 is manufactured in a manner that enhances bonding between jacketing polymer material (e.g. 155, 355) and an underlying metallic core (e.g. 110, 200, 201) as shown in FIGS. 1-3. This enhanced bonding may help to ensure long-term conductive isolation for sake of telemetric communications between the logging tool 485 and the control unit 430 as well as the supply of power to the tool 485 by the unit 430. Overall, a more robust slickline 390 may be made available for use in the harsh environment of the oilfield.

The improved durability of the slickline 390 may also be of benefit even before accessing the well 480. For example, as shown in FIG. 4, the slickline 390 may be spooled to and from a drum 415 and pass over sheaves 452, 453 at a rig before being run through pressure control equipment 455 and ultimately accessing the well 480. The ability of the slickline 390 to remain reliably bonded and intact throughout such tortuous manipulation reduces the risk of subsequent failure during the depicted logging application.

Figure 5:
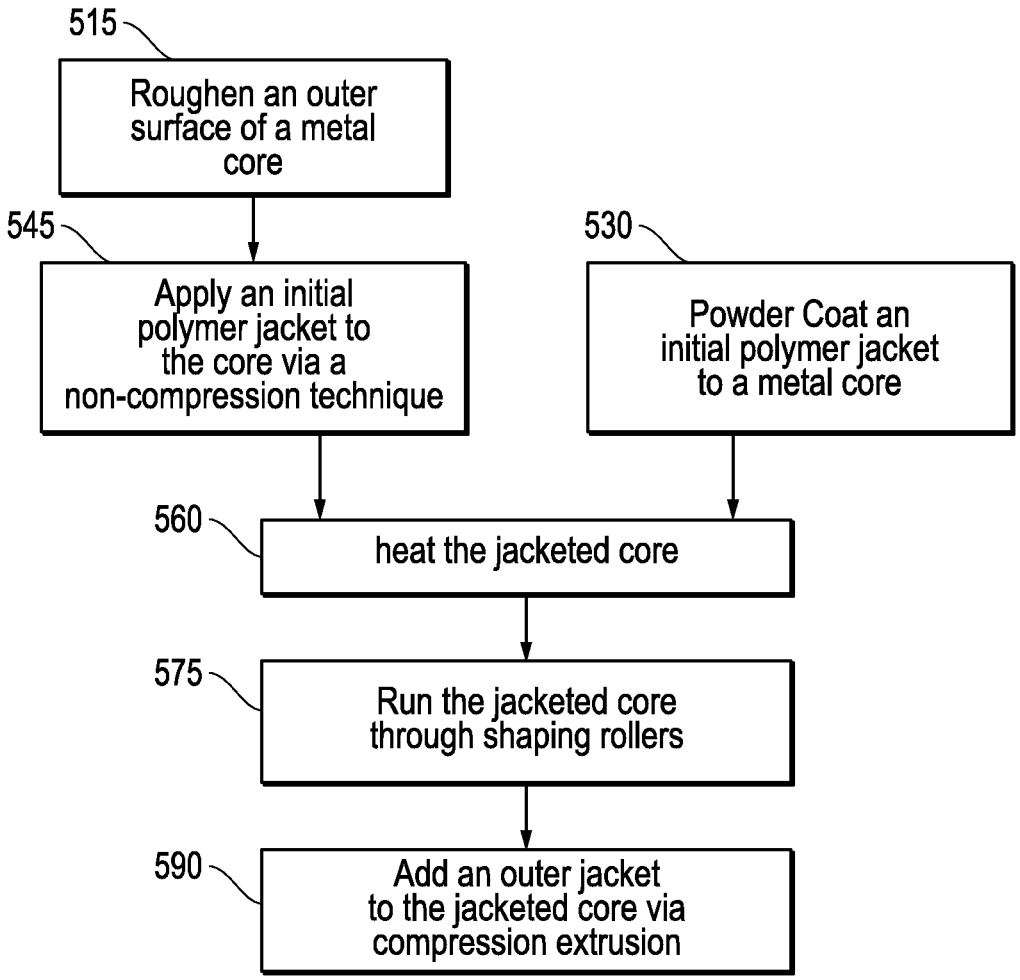
FIG. 5 is a flow-chart summarizing embodiments of slickline manufacturing techniques.

Referring now to FIG. 5, a flow-chart is shown which summarizes embodiments of slickline or other jacketed metal line manufacturing techniques as described hereinabove. Specifically, a metal core may be roughened through one of a variety of different techniques as indicated at 515 followed by application of an initial polymer jacket thereto via a non-compression technique such as by tubing extrusion (see 545). On the other hand, as indicated at 530, the initial polymer jacket may be provided by way of powder coating to a metal core that is not necessarily roughened ahead of time.

With a thin initial layer of polymer jacket now adhered to the underlying metal core, the bonding may be enhanced by application of heat and shaping rollers as indicated at 560 and 575. Thus, the manner by which the initial polymer jacket is provided does not materially affect the outer surface of the core and/or its bonding capacity relative this first jacket layer.

In some embodiments, processing may be stopped with this initially jacketed core. For example, sufficient insulating and protection may be provided via the initial jacket alone or, in some circumstances, initially jacketed cores may be made and stored as is for later processing and completion according to tailored specifications. Regardless, as indicated at 590, additional jacketing by way of compression extrusion, may take place to bring the slickline up to the full intended profile.

In circumstances where the initially jacketed core had been stored for a period prior to addition of the outer jacket, heat is applied before running the line through such compression extrusion. Additionally, in certain embodiments, addition of the initial jacket or later jacketing may be followed by active or controlled cooling so as to minimize the degree to which the metal core and jacketing materials cool at differing rates. Controlled cooling comprises cooling the jacket and/or jacketing slowly in a controlled manner or environment in order to promote the continuation of the bonding between the various materials. For example, the initially jacketed core may be run through or otherwise exposed to a coolant or conventional heat removal system/refrigeration. Thus, defects from such cooling rate disparity may be reduced.

Figure 6A:
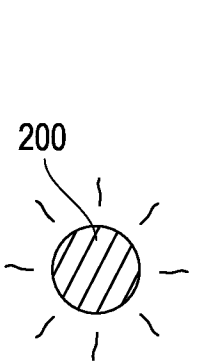
FIGS. 6A-6G are side cross-sectional views of an embodiment of a metal core being manufactured into the slickline of FIG. 3.
Figure 6B:
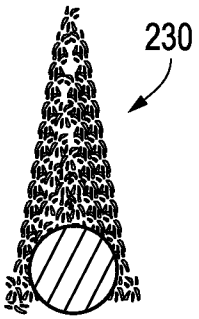
Figure 6C:
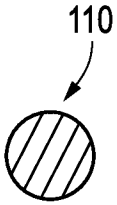
Figure 6D:
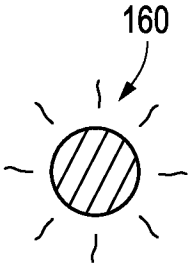

Referring now to FIGS. 6A-6G, a different perspective of an embodiment of manufacturing techniques detailed above is shown in sequence. Specifically, FIGS. 6A-6G show side cross-sectional views of a metal core being manufactured into the slickline 390 of FIG. 3. For example, in FIGS. 6A and 6B, a smooth metal core 200 may be heated then roughened 230 by a technique such as sandblasting as detailed above with respect to FIG. 2A. Thus, a roughened metal core 110 may be rendered as shown in FIG. 6C. Subsequently, with added reference to FIG. 1 and as shown in FIG. 6D, the core 110 may be heated and a thin initial polymer layer 155 may be delivered via a non-compression technique to form a jacketed core 160. Of course, as detailed above, where the polymer layer 155 is delivered via a spray powder, pre-treating or roughening of the core 200 may be avoided if desired.

Figure 6E:
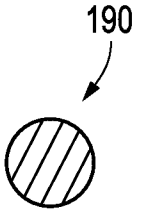
Figure 6F:
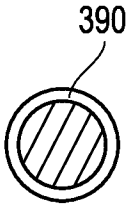
Figure 6G:
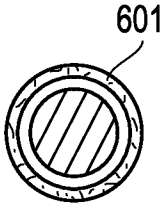

Continuing with reference to FIG. 6E, the heated jacketed core 160 of FIG. 6D may be shaped by shaping rollers 180 as shown in FIG. 1. Thus, a formed slickline 190 with an initial layer of jacketing may be available. Further jacketing may be provided, for example, by compression extrusion to form a completed slickline 390 of the desired profile for a downhole application such as that depicted in FIG. 4. Indeed, in the embodiment of FIG. 6G, even further jacketing may be provided such as by the addition of another polymer layer 601. For example, the added layer 601 may have reinforcing agent or additive incorporated thereinto such as carbon fiber.

Embodiments detailed hereinabove include techniques for enhancing bonding between a metal core and a polymer jacketing placed thereover. This is achieved in manners that may provide jacketing while avoiding material changes to the surface of the metal core. Thus, subsequent heat and/or shaping rollers may be used to increase the grip between the polymer and metal. Once more, once this initial polymer grip is established, additional polymer jacketing may take place with polymer to polymer adherence assured. As such, a line may be provided that is of improved long term reliability in terms of power and telemetry due to the enhanced bonding of the insulating jacket about the metal core.

Figure 7:
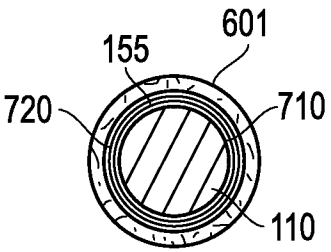
FIG. 7 depicts an example slickline.

FIG. 7 depicts an example slickline. The slickline 700 can include the metal core 110, the initial polymer layer 155, and the additional polymer layer 601.

A first tie layer 710 can be located between the initial polymer layer 155 and the metal core 110. A second tie layer 720 can be located between the initial polymer layer 155 and the additional polymer layer 601.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, while techniques utilized are directed at jacketing a metal core for an oilfield conveyance or line, these techniques may be modified and applied to other hardware such as metallic tool housings. Regardless, the foregoing description should not be read as pertaining only to the precise structures described and shown in the accompanying drawings, but rather should be read as consistent with and as support for the following claims, which are to have their fullest and fairest scope.

We claim:

1. A method of manufacturing a jacketed metal line, the method comprising:

roughening an outer surface of a metal core of the line;

applying an insulating polymer layer to the roughened metal core, wherein the insulating polymer layer is a first polymer layer of between about 0.001 inches and about 0.010 inches in thickness and comprises a reinforcing additive comprising: graphite, carbon, glass, aramid, short-fiber filled PolyEtherEtherKetone, mircron-sized polytetrafluoroethylene, or combinations thereof;

exposing the insulated roughened metal core to a heat source for at least partially melting the first polymer layer;

running the insulated roughened metal core with the partially melted polymer layer through a set of shaping rollers;

providing a tie layer between the roughened metal core and the insulating polymer layer to promote bonding between the roughened metal core and the insulating polymer layer;

applying a second polymer layer over the first polymer layer; and running the first and second polymer layered core through another set of shaping rollers.

2. The method of claim 1, further comprising exposing the first polymer layered core to a heat source prior to the applying of the second polymer layer.

3. The method of claim 1, wherein the applying of the second polymer layer is achieved by compression extrusion.

4. The method of claim 1, further comprising providing a tie layer between the first polymer layer and the second polymer layer.

5. The method of claim 1, wherein applying an insulating polymer layer to the roughened metal core comprises using a non-compression technique.

6. The method of claim 1, wherein the insulating polymer layer is a short-fiber filled PolyEtherEtherKetone comprising short fiber material, wherein the short fiber material is from about 0.5% to about 30% of the total volume of the short-fiber filled PolyEtherEtherKetone.

7. The method of claim 1, wherein the roughening of the outer of the metal core surface is achieved by one of arc spraying, abrasive blasting, and electrolytic plasma coating.

8. The method of claim 7, wherein the arc spraying comprises:

charging wires of metal based material; and spraying molten droplets of the charged metal based material onto the heated core for the roughening.

9. The method of claim 7, wherein the abrasive blasting comprises:

heating the metal core; and sandblasting the heated metal core with a fine-grit medium for the roughening.

10. The method of claim 7, wherein the electrolytic plasma coating comprises:

charging the metal core; and running the core through a liquid bath of oppositely charged metals for bonding to the outer surface of the charged core for the roughening.

11. A method of manufacturing a jacketed metal line, the method comprising:

roughening an outer surface of a metal core of the line;

charging the metal core of the line;

powder coating the charged line with a charged insulating polymer, where a charge of the charged insulating polymer is opposite a charge of the metal core;

exposing the insulated metal core to a heat source for at least partially melting the polymer forming a first polymer layer;

running the insulated metal core with the partially melted polymer through a set of shaping rollers;

applying a second polymer layer over the first polymer layer; and running the first and second polymer layered core through another set of shaping rollers; and providing a tie layer between the metal core and the first polymer layer to promote bonding between the metal core and the polymer.

12. The method of claim 11, wherein the melted insulating polymer is the first polymer layer of between about 0.001 inches and about 0.010 inches on the core, the method further comprising:

heating the first polymer layer;

applying the second polymer layer over the first polymer layer via compression extrusion; and running the insulated metal core with the two polymer layers through the another set of shaping rollers.

13. A method of manufacturing a polymer jacketed metal line comprising:

roughening an outer surface of a metal core of the line;

charging the metal core of the line;

running the core through a liquid bath of oppositely charged metals for bonding to the surface of the charged core for the roughening;

placing a short-fiber filled PolyEtherEtherKetone layer about the roughened metal core;

heating the short-fiber filled PolyEtherEtherKetone layer;

placing a polymer alloy layer about the short-fiber filled PolyEtherEtherKetone layer, wherein the polymer alloy layer comprises fluoropolymer particles in a matrix of PolyEtherEtherKetone forming a bonded fluoropolymer outer jacket with the fluoropolymer particles diffused to a surface of the polymer alloy layer;

heating the bonded fluoropolymer outer jacket; and extruding a layer of pure fluoropolymer about the bonded fluoropolymer outer jacket.

14. The method of claim 13, wherein the short-fiber filled PolyEtherEtherKetone layer is heated before the polymer alloy layer is disposed thereabout.

15. The method of claim 13, wherein the short-fiber filled PolyEtherEtherKetone layer comprises short fiber material, and wherein the short fiber material is from about 0.5% to about 30% of the total volume of the short-fiber filled PolyEtherEtherKetone.

16. The method of claim 15, wherein the short fiber material is carbon, glass, an inorganic fiber, a filler with a low coefficient of thermal expansion, or combinations thereof.

* * * * *